US006789309B2

(12) United States Patent
Kondo

(10) Patent No.: US 6,789,309 B2
(45) Date of Patent: Sep. 14, 2004

(54) SELF-PIERCING ROBOTIC RIVET SETTING SYSTEM

(75) Inventor: Yoshiteru Kondo, Toyohashi (JP)

(73) Assignee: Newfrey LLC, Newark, DE (US)

( * ) Notice: Subject to any disclaimer, the term of this patent is extended or adjusted under 35 U.S.C. 154(b) by 60 days.

(21) Appl. No.: 09/946,434

(22) Filed: Sep. 4, 2001

(65) Prior Publication Data

US 2002/0029450 A1 Mar. 14, 2002

Related U.S. Application Data

(63) Continuation-in-part of application No. 09/768,965, filed on Jan. 24, 2001, now abandoned.

(30) Foreign Application Priority Data

Feb. 22, 2000 (JP) ..... 2000-044200

(51) Int. Cl.[7] ..... B23P 21/00

(52) U.S. Cl. ..... 29/709; 29/712; 29/714; 29/715; 29/798; 29/243.53; 29/276; 29/407.01; 29/407.05; 29/407.08; 29/432.2; 29/505; 29/525.05; 29/525.06; 901/9; 901/41; 700/175; 700/160

(58) Field of Search ..... 29/407.01, 407.05, 29/407.08, 407.09, 407.1, 432.2, 505, 509, 524.1, 525.01, 525.05, 525.06, 701, 703, 709, 712, 714, 715, 798, 243.53, 276, 283.5, 818; 901/9, 46, 41; 700/175, 160, 174

(56) References Cited

U.S. PATENT DOCUMENTS 3,465,410 A * 9/1969 Ernest et al. ..... 29/243.5
4,620,656 A 11/1986 McClay et al.
4,662,556 A 5/1987 Gidlund
4,901,431 A * 2/1990 Gast ..... 29/707
4,955,119 A 9/1990 Bonomi et al.
5,060,362 A * 10/1991 Birke et al. ..... 29/243.53
5,465,868 A * 11/1995 Bonomi ..... 221/165
5,471,865 A 12/1995 Michalewski et al.
5,491,372 A 2/1996 Erhart
5,502,884 A * 4/1996 Ladouceur ..... 29/407.05

(List continued on next page.)

FOREIGN PATENT DOCUMENTS

DE 3916014 A1 * 11/1990 ..... 29/243.53
EP 0512649 A1 * 11/1992
EP 0 970 766 A2 1/2000
JP 7-108497 4/1995

OTHER PUBLICATIONS

European Search Report for EP 01 30 1512, 3 pages.

*Primary Examiner*—David P. Bryant
*Assistant Examiner*—Jermie E. Cozart
(74) *Attorney, Agent, or Firm*—Harness, Dickey & Pierce, P.L.C.

(57) ABSTRACT

A self-piercing type rivet setting system 30 comprises: a rivet swaging assembly 35; a robot 6 which moves the rivet swaging assembly 35 to put it in position relative to a predetermined site on a workpiece to be riveted; a single integrated controller 31 made up by an integration of a controller for controlling a riveting operation of the rivet swaging assembly and a controller for controlling the motion of the robot; and a rivet feeder 9 for automatically feeding a self-piercing type rivet to the rivet swaging assembly. From the integrated controller 31, a interface cable 33 extends to the robot 6 and another interface cable 34 extends to the rivet feeder 9, and the rivet swaging assembly 35 is integrally incorporated into the robot 6.

19 Claims, 9 Drawing Sheets

U.S. PATENT DOCUMENTS 5,575,166 A 11/1996 Michalewski et al.
5,957,362 A 9/1999 Samulowitz et al.
5,964,393 A * 10/1999 Feldpausch et al. ..... 227/135
6,011,482 A 1/2000 Banks et al.
6,014,802 A * 1/2000 Guerin ..... 29/714
6,014,804 A 1/2000 Lulay et al.
6,058,598 A 5/2000 Dixon et al.
6,067,696 A * 5/2000 Cecil et al. ..... 29/709
6,199,271 B1 3/2001 Hahn et al.
6,219,898 B1 4/2001 Kubanek et al.
6,276,050 B1 * 8/2001 Mauer et al. ..... 29/716
6,295,710 B1 * 10/2001 Roberts et al. ..... 29/798
6,347,449 B1 2/2002 Calkins et al.
6,385,843 B1 5/2002 Singh et al.

* cited by examiner

SELF-PIERCING ROBOTIC RIVET SETTING SYSTEM

CROSS-REFERENCE TO RELATED APPLICATION

This is a continuation-in-part of U.S. patent application Ser. No. 09/768,965, filed Jan. 24, 2001 now abandoned and entitled "Self Piercing Type Rivet Setting System," assigned to the assignee of the present invention.

BACKGROUND OF THE INVENTION

The present invention relates to a self-piercing type rivet setting system, and in more particular, to a self-piercing type rivet setting system suitable to cooperate with an electrically controlled system, such as a robot or a jig, which is used when two sheets or three or more sheets of plate members (or a plate member and a part) are riveted using a self-piercing type rivet in a sheet metal assembling operation, for example, in a car body assembling operation (especially in an aluminum body assembling operation).

An exemplary self-piercing type rivet setting system has been disclosed in European Patent Specification EP 0 893 179. FIG. 2 thereof shows an exemplary self-piercing type rivet. Basically, the self-piercing type rivet is formed with a flange-like head portion and two legs extending from the head portion. When the rivet is driven by a punch and die into a workpiece to be riveted, for example, into two sheets of body panels, the legs deform at their tips to be expanded while piercing the panels thus to couple the panels with each other by the expanded leg portion and the head portion. A self-piercing type rivet is suitable for coupling of aluminum body members for which the welding cannot be made, and further, demand for a self-piercing type rivet is expected since more aluminum body members will be prospectively employed for a car body member to meet an increasing requirement for a weight reduction thereof.

Though not disclosed in the above patent document, a conventional self-piercing type rivet setting system driven by oil pressure or electric power comprises an independent rivet swaging assembly and a jig or robot as a means for moving the rivet swaging assembly to put it in position relative to a predetermined site to be riveted on a workpiece. The rivet swaging assembly is mounted on a front end of an arm of the robot or jig. Such conventional apparatus needs, in addition to the rivet swaging assembly for the self-piercing type rivet and an controller therefor, a jig or robot and another controller for controlling the jig or robot to be driven, which has made a cost of an arrangement expensive. Further, in a facility where a robot or jig moves the rivet swaging assembly to the working sites, the rivet swaging assembly has a built-in driving unit therein, so as to make its volume as a whole bulky. Yet further, an interface cable extending from the controller to the rivet swaging assembly has interfered with complexity in geometry of a car body and the like, leaving some sites unavailable to be riveted.

SUMMARY OF THE PRESENT INVENTION

In accordance with the present invention, a self-piercing type rivet setting system is provided that employs a single integrated controller. The rivet setting system comprising: a rivet swaging assembly for setting a self-piercing type rivet; a first controller for controlling a riveting operation of the rivet swaging assembly; a moving means for moving the rivet swaging assembly to put it in position relative to a predetermined site to be riveted on a workpiece; a second controller for controlling an operation of the moving means; and a rivet feeder for automatically feeding a self-piercing type rivet to the rivet swaging assembly; and wherein the first controller also controls a feeding of the self-piercing type rivet from the rivet feeder; the self-piercing type rivet setting system is characterized in that the first controller is incorporated into the second controller to be formed into a single integrated controller, and the rivet swaging assembly is integrally incorporated into the moving means. It should be noted that from the integrated controller, one interface cable extends to the moving means and another interface cable to the rivet feeder.

In the self-piercing type rivet setting system described above, the moving means for moving the rivet swaging assembly may be a robot or a jig. In this case, the rivet swaging assembly may comprise: a C-shaped frame mounted on a front end of an arm of an articulated robot; a die mounted to one end of the C-shaped frame; a punch mounted to other end of the C-shaped frame, the punch opposed to the die to be capable of moving into contact with/away from the die; and a means for movably supporting the punch allowing the punch to move into contact with/away from the die, the means for movably supporting the punch comprising an electric drive motor fixedly mounted on the front end of the robot arm and a link arm coupled with the motor for moving the punch in a linear direction, which allows a mechanical structure of a riveting function portion to be made more compact.

As described above, according to the present invention, since the controller for the moving means (e.g. a robot or jig) for moving the rivet swaging assembly to put it in position relative to a predetermined site on a workpiece to be riveted, or the second controller, is incorporated with another controller for the rivet swaging assembly of the self-piercing type rivet, or the first controller, to be formed into a single integrated controller, the housing for the first controller is not necessary any more and also the interface cable between the controller for the rivet swaging assembly and the another controller for the moving means such as a robot is not necessary, though both being necessary for the conventional apparatus. Further, since, in addition to the integration of the controllers, the rivet swaging assembly is incorporated into the moving means such as a robot, the interface cable extending from the controller for the rivet swaging assembly to the rivet swaging assembly is no longer necessary, which is necessary for the conventional apparatus, and this reduces a possible interference with the workpiece to be riveted and ensures the riveting operation to be performed at a desired site. Thus, a size of the self-piercing type rivet setting system as a whole, a cost thereof and a size of the rivet swaging assembly could be reduced, and still further a number of interface cables could be reduced.

BRIEF DESCRIPTION OF THE ACCOMPANYING DRAWINGS

DETAILED DESCRIPTION OF THE PREFERRED EMBODIMENTS

Figure 1:
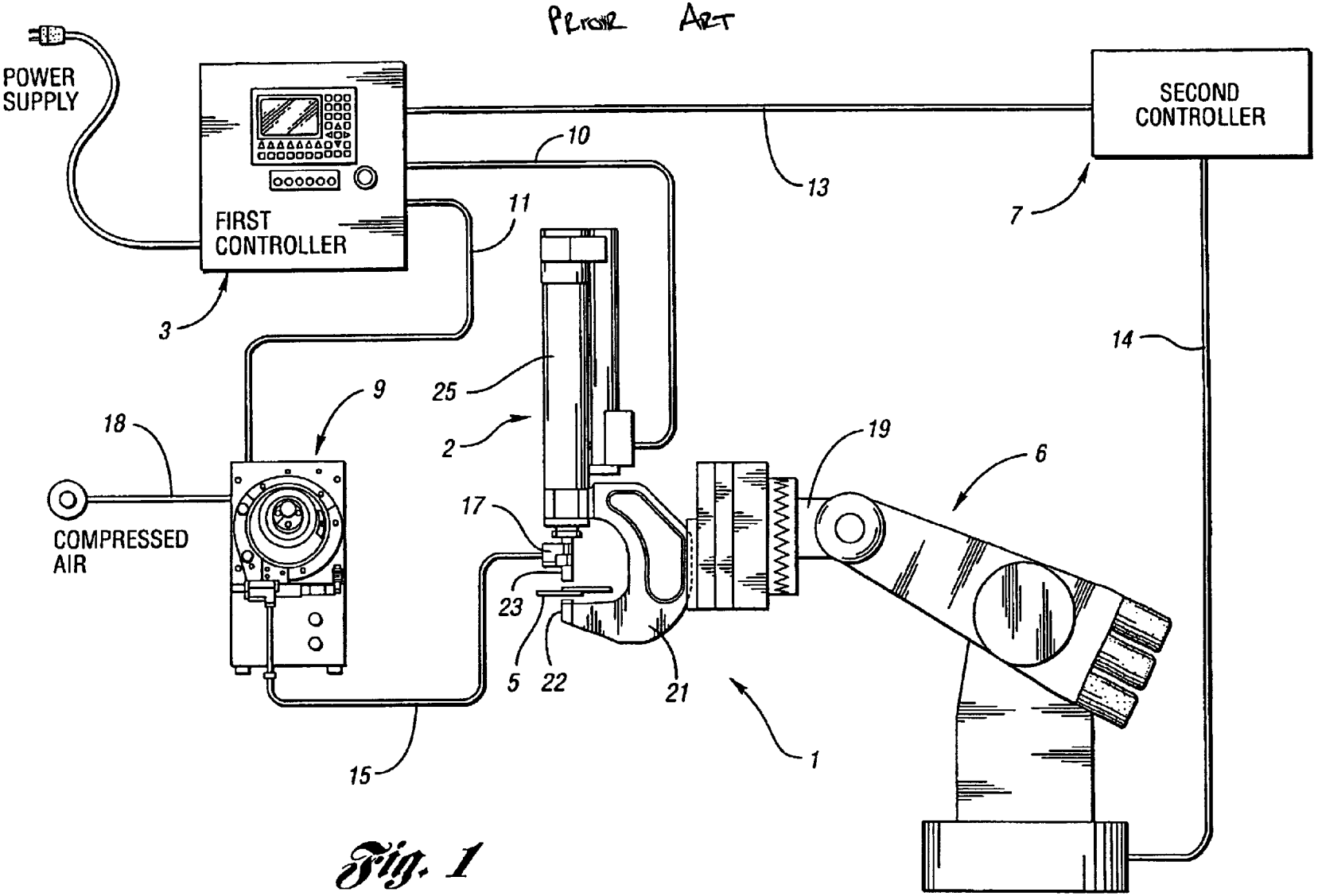
Prior Art Fig. 1
FIG. 1 is a schematic diagram of a self-piercing type rivet setting system according to the prior art.

Prior to giving a detailed description of a preferred embodiment according to the present invention, a conventional self-piercing type rivet setting system 1 will be described with reference to FIG. 1. Referring to FIG. 1, the conventional self-piercing type rivet setting system 1 comprises: a rivet swaging assembly 2 for setting a self-piercing type rivet; a first controller 3 for controlling a riveting operation of the rivet swaging assembly 2; a robot 6 (or a jig) as a moving means for moving the rivet swaging assembly 2 to put it in position relative to a predetermined site to be riveted on a panel 5 as a workpiece; a second controller 7 for controlling an operation of the robot 6; and a rivet feeder 9 for automatically feeding a self-piercing type rivet to the rivet swaging assembly 2. Further, the first controller 3 also controls the feeding of the self-piercing type rivet from the rivet feeder 9. The first controller 3 has a first interface cable 10 which is connected to the rivet swaging assembly 2 to control the rivet swaging assembly 2, a second interface cable 11 which is connected to the rivet feeder 9 to control the rivet feeder 9, and further a third interface cable 13 which is connected to the second controller 7 to provide for cooperation between the motion of the rivet swaging assembly 2 and that of the robot 6 for riveting operation. The second controller 7 has, in addition to the third interface cable 13 connected to the first controller 3, a fourth interface cable 14 which is connected to the robot 6 (or a jig) as a rivet swaging assembly moving means to control the robot 6 or the like. Further, a feeding tube 15 extends from the rivet feeder 9 to a receiver mechanism 17 located in a head portion of the rivet swaging assembly 2 for successively feeding the self-piercing type rivets one after another to the rivet swaging assembly 2. Since the feeding operation of the rivet from the rivet feeder 9 is performed using compressed air, the rivet feeder 9 is supplied with compressed air though a pipe 18.

The rivet swaging assembly 2 comprises: a C-shaped frame 21 mounted on a front end of an arm 19 of an articulated robot 6; a die 22 mounted to one end (a lower end in the illustrated embodiment) of the C-shaped frame 21; a punch 23 mounted to other end (upper end) of the C-shaped frame 21, the punch 23 opposed to the die 22 so as to be capable of moving into contact with/away from the die 22; and an electric drive motor 25 for movably supporting the punch 23 allowing the punch 23 to move into transmission mechanism contact with/away from the die 22. The electric motor 25 has a shaft with a lead screw formed thereon to apply a force to the punch 23 to strongly press the self-piercing type rivet held in the punch 23 into the die 22 side. Reversing the rotation of the electric motor 25 can retract the punch 23. The self-piercing type rivet fed from the receiver mechanism 17 is held on the tip of the punch 23. The C-shaped frame 21 is advantageously formed so as to pinch the panels to be riveted or swaged at a riveting site thereof between the punch 23 and the die 22, each being located in an upper or a lower side respectively.

The first controller 3, in order to control a riveting operation of the rivet swaging assembly 2, has: a first function of controlling the electric drive motor 25; a second function of measuring a riveting pressure applied to the punch 23 by the electric motor 25 and a displacement thereof based on a signal from a sensor (not shown), and determining whether or not the measured value falls within a predetermined range; and a third monitor function of measuring, prior to a riveting operation, a length of the self-piercing type rivet and a thickness of the panel 5 as a workpiece to be riveted. Those functions are transmitted between the first controller 3 and the rivet swaging assembly 2 through the first interface cable 10. The first controller 3 has another function of controlling the rivet feeder 9 through the second interface cable 11, and also the first controller 3 sends a control signal over the fourth interface cable 14 to the second controller 7 for controlling the rivet swaging assembly moving means such as the robot 6 (or a jig) so as to adaptively act to the operation of the rivet swaging assembly. To the fourth interface cable 14, various signals are also sent from the second controller 7 for cooperative actuation between the rivet swaging assembly 2 and the robot 6.

In operation, the self-piercing type rivet is sent from the rivet feeder 9 to the receiver 17 by a command from the first controller 3 and the rivet is held in the punch 23. On the other hand, the second controller 7, based on a signal from the first controller 3, sends a command to the robot 6 so that prior to the riveting operation, the robot moves the C-shaped frame 21 to a position where the punch 23 and the die 22 are to pinch the panel 5 as a workpiece is to be riveted at a predetermined site thereof to place the rivet swaging assembly 2 in position. After this positioning of the rivet swaging assembly 2, the electric drive motor 25 of the rivet swaging assembly 2 is actuated and then, the punch 23 applies the pressure onto a head portion of the rivet in a direction toward the die 22, so that leg portions of the rivet pierce through the first panel of the two panels and further into the second panel until they stop piercing in mid course where the tip portion of the leg deforms to be expanded, thereby to couple the panels to each other by this expanded leg portion and the head portion of the rivet. Following this riveting operation, the rotation of the motor reverses to retract the punch 23, and the next self-piercing type rivet is fed to the receiver mechanism 17 to complete the preparation for the next riveting operation. The self-piercing type rivet setting system 1 according to the prior art has been fully explained by the above description.

Figure 2:
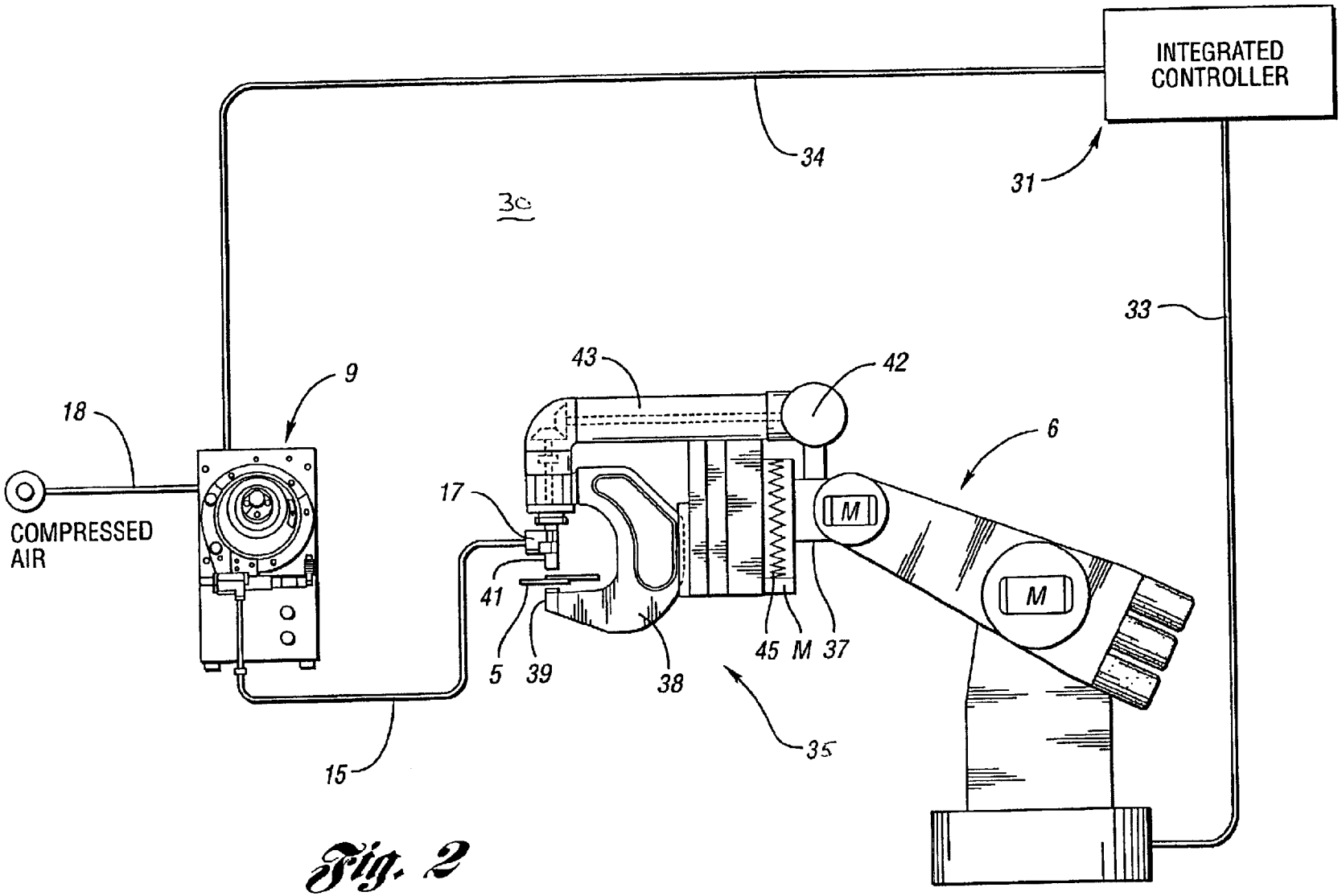
FIG. 2 is a schematic diagram of a self-piercing type rivet setting system according to the present invention.

A self-piercing type rivet setting system 30 according to the present invention will now be described with reference to FIG. 2. In the present invention, the first controller is incorporated in the second controller to form a single integrated controller 31. From the integrated controller 31, a single interface cable 33 extends to a robot 6 serving as the moving means and an additional single interface cable 34 extends to a rivet feeder 9. Further, a rivet swaging assembly 35 is integrally incorporated onto the robot 6. Although the illustrated robot 6 is of an articulated electric robot type that is commonly used in a production line of automobiles, other types of robots or jigs are also available so far as they are capable of positioning the rivet swaging assembly in the predetermined site.

The rivet swaging assembly 35 comprises: a C-shaped frame 38 mounted together with an interface connector to a front end of an arm 37 of the articulated robot 6 through a coupling device 45; a die 39 mounted to one end of the C-shaped frame 38; a punch 41 mounted to other end of the C-shaped frame 38, the punch 41 opposed to the die 39 to be capable of moving into contact with/away from the die 39; and a means for movably supporting the punch 41 allowing the punch 41 to move into contact with/away from the die 39. The means for movably supporting the punch 41 comprises an electric drive motor 42 fixedly mounted on a front end of the robot arm 37 and a transmission mechanism (not shown) coupled to the motor 42 for moving the punch 41 in a linear direction. A housing 43 containing the drive motor 42 therein is formed to extend horizontally, which is different from the one according to the prior art in which it is formed to extend vertically. Accordingly, the height of the rivet swaging assembly is advantageously reduced so that the device could move even into a narrow space. Although the horizontal housing is presently preferred, this is not intended as a limitation on the broader aspects of the present invention.

Figure 3:
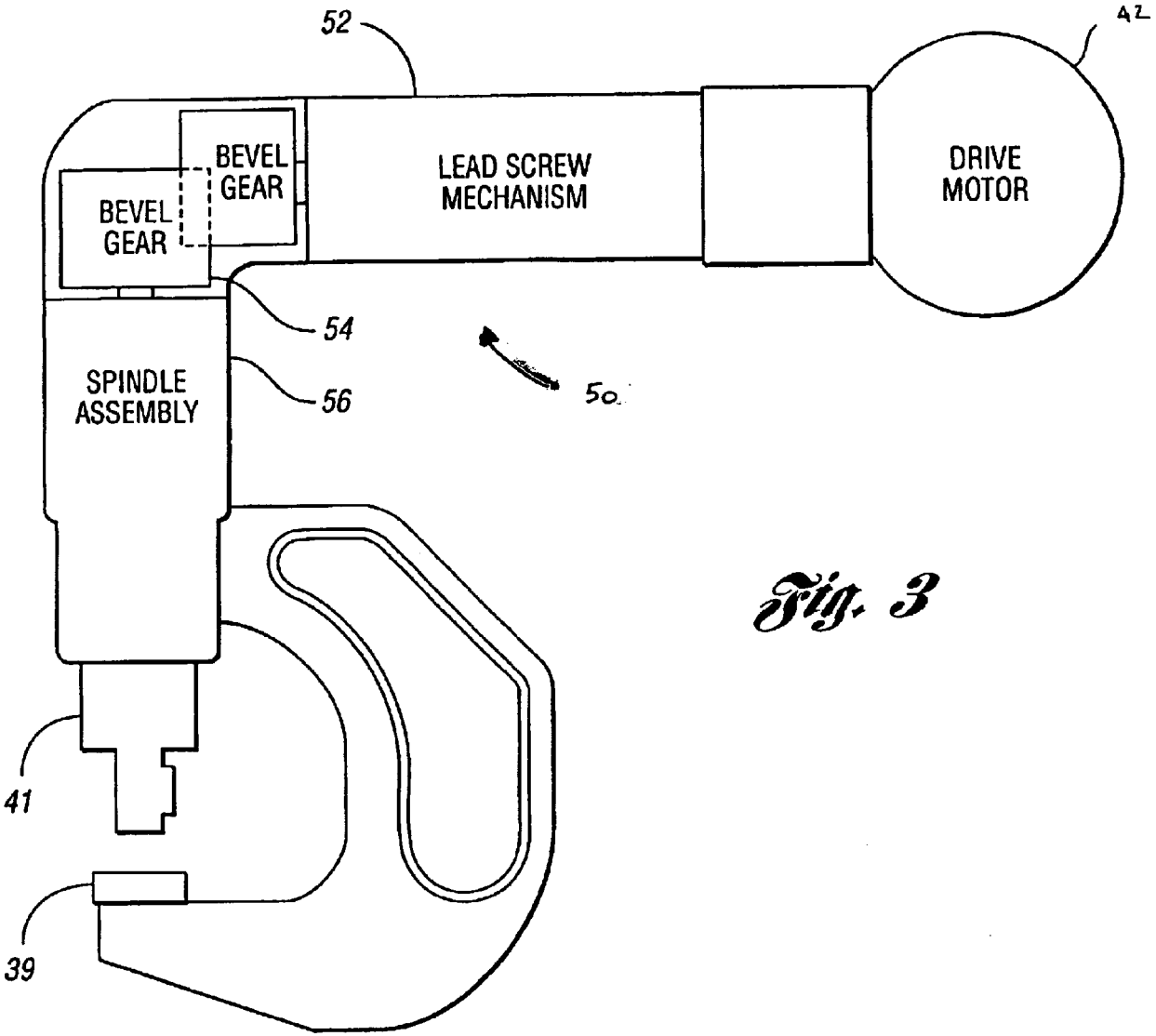
FIG. 3 is a block diagram of an exemplary transmission mechanism which may be employed by the rivet swaging assembly of the present invention.

The transmission mechanism 50 is preferably operable to translate the rotary motion of the electric drive motor 42 into linear motion for actuating the punch 41 as shown in FIG. 3. The transmission mechanism may include a lead screw mechanism 52 arranged in the horizontal housing portion, at least two bevel gears 54 and a spindle assembly 56 arranged in the vertical housing portion. The two bevel gears 54 serve as the intermediary between the lead screw mechanism and the spindle assembly 56. In particular, the two bevel gears cooperatively operate to transmit the rotary motion of the lead screw mechanism into linear motion applied to the spindle assembly as is well known in the art.

Figure 4:
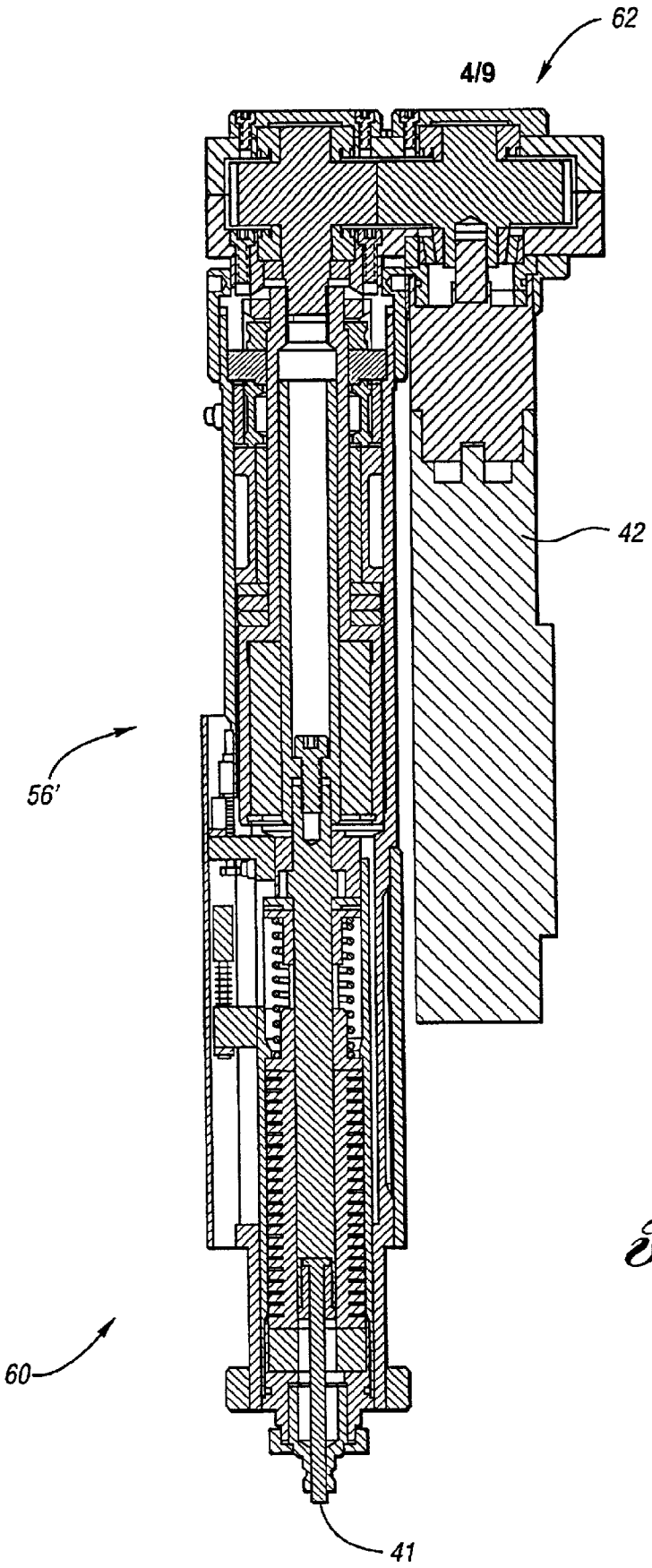
FIGS. 4 and 5 are cross sectional views illustrating alternative mechanically driven transmission mechanisms which may be employed by the rivet swaging assembly of the present invention.
Figure 5:
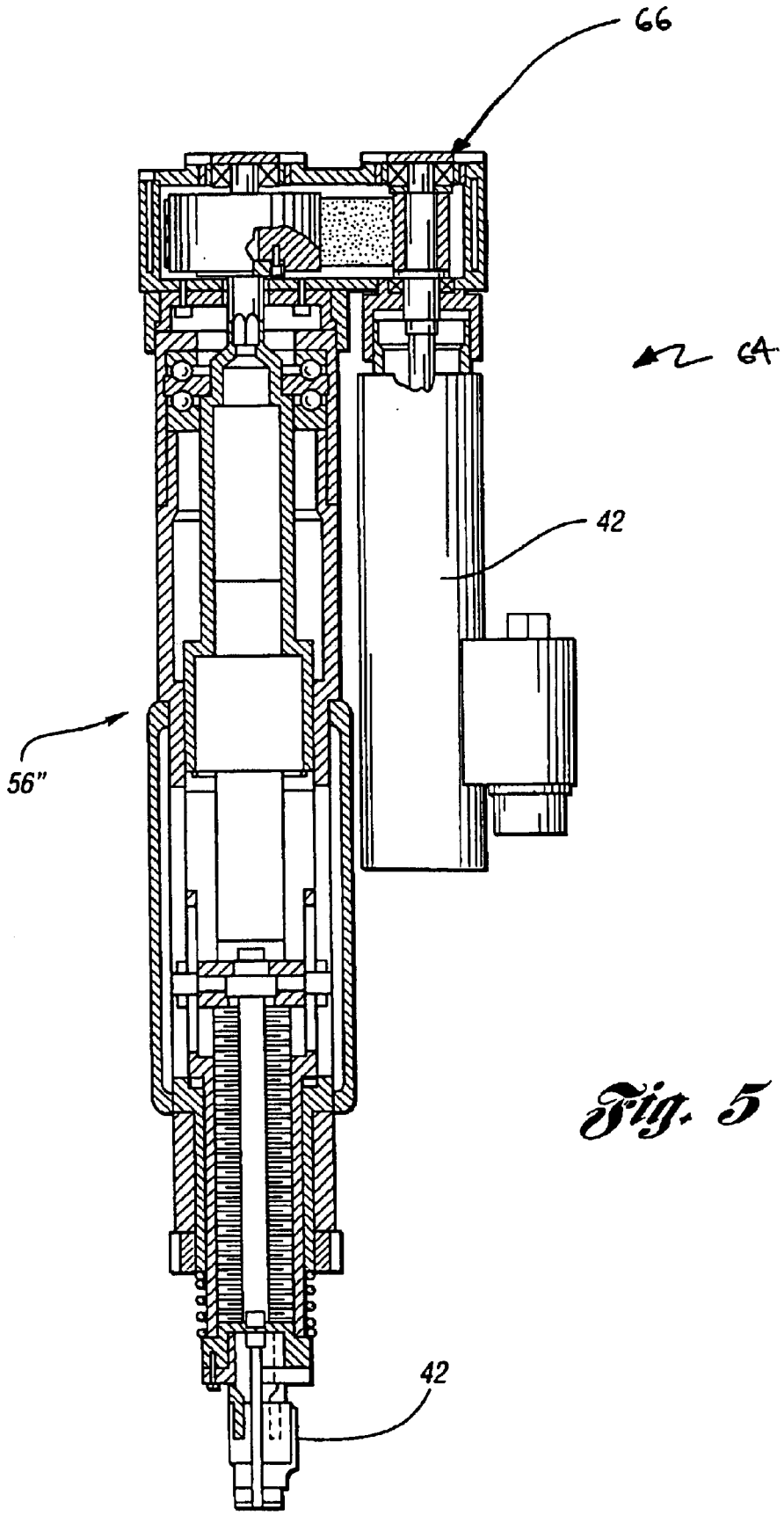

Alternative mechanically driven transmission mechanisms are depicted in FIGS. 4 and 5. In FIG. 4, transmission mechanism 60 includes a gear drive assembly 62 and a spindle assembly 56'. The electric drive motor 42 operably engages the gear drive assembly 62 which in turn engages the spindle assembly 56'. In FIG. 5, transmission mechanism 64 includes a belt drive mechanism 66 and a spindle assembly 56". Likewise, the electric drive motor 42 operably engages a belt drive assembly 62 which in turn engages the spindle assembly 56". In either case, the transmission mechanism translates the rotary motion of the drive motor 42 into linear motion for actuating the punch 41. A more detailed explanation of each transmission mechanism is provided in U.S. Pat. No. 6,276,050, issued on Aug. 21, 2001 which is incorporated by reference herein. Each of the above-described transmission mechanisms may be adapted for use in a horizontal housing configuration.

Figure 6:
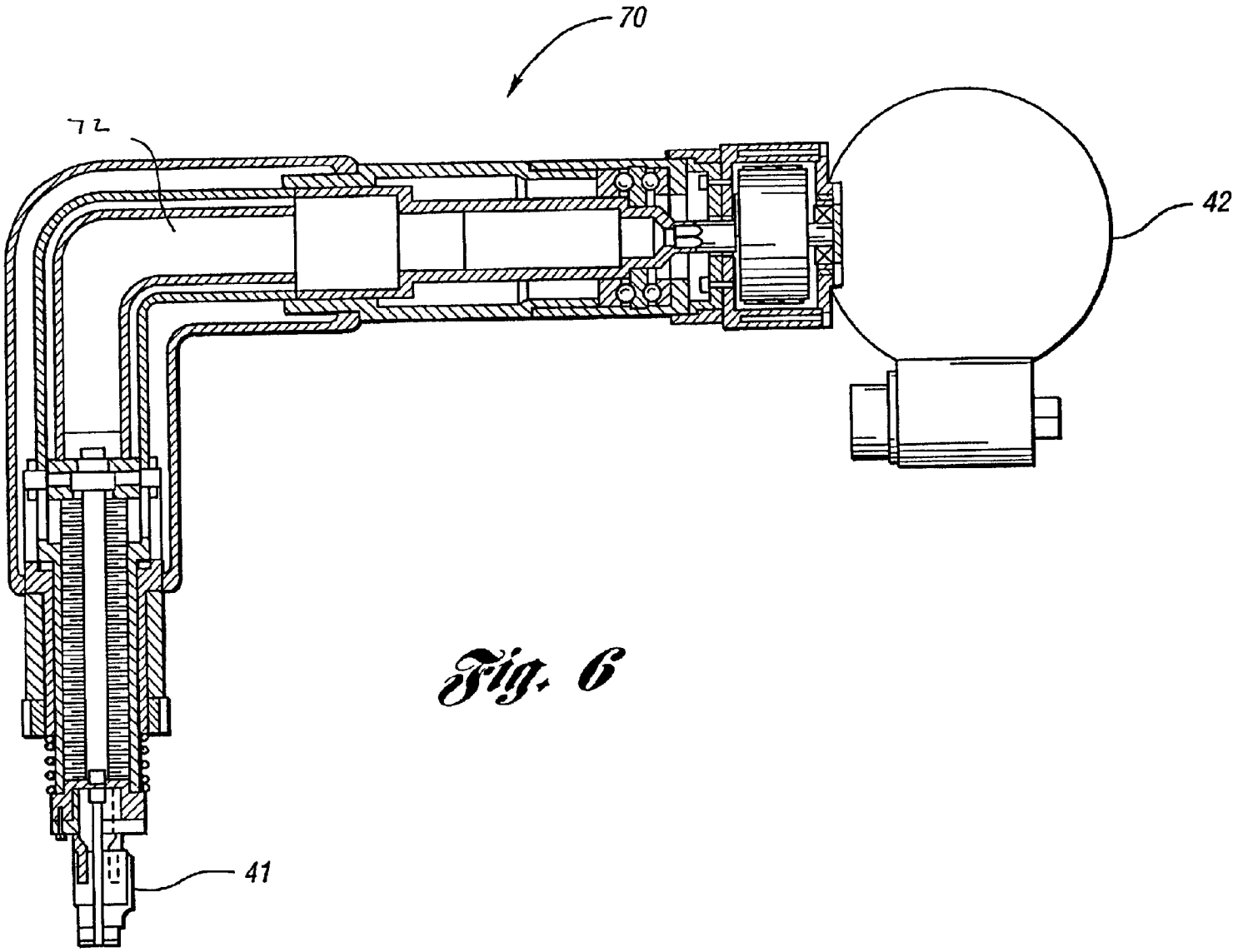
FIG. 6 is a cross sectional view illustrating a hydraulically driven transmission mechanism which may be employed by the rivet swaging assembly of the present invention.

While the above description is provided with reference to mechanically driven transmission mechanisms, it is readily understood that other transmission mechanisms are also within the scope of the present invention. For instance, a hydraulically driven transmission mechanism 70 may be suitably used in the rivet swaging assembly 35 as shown in FIG. 6. In this case, a hydraulic cylinder 72 is used to translate the rotary motion from the drive motor 42 into linear motion to actuate the punch 41. It is envisioned that other configurations for the transmission mechanism may be employed by the rivet swaging assembly 35.

Figure 7:
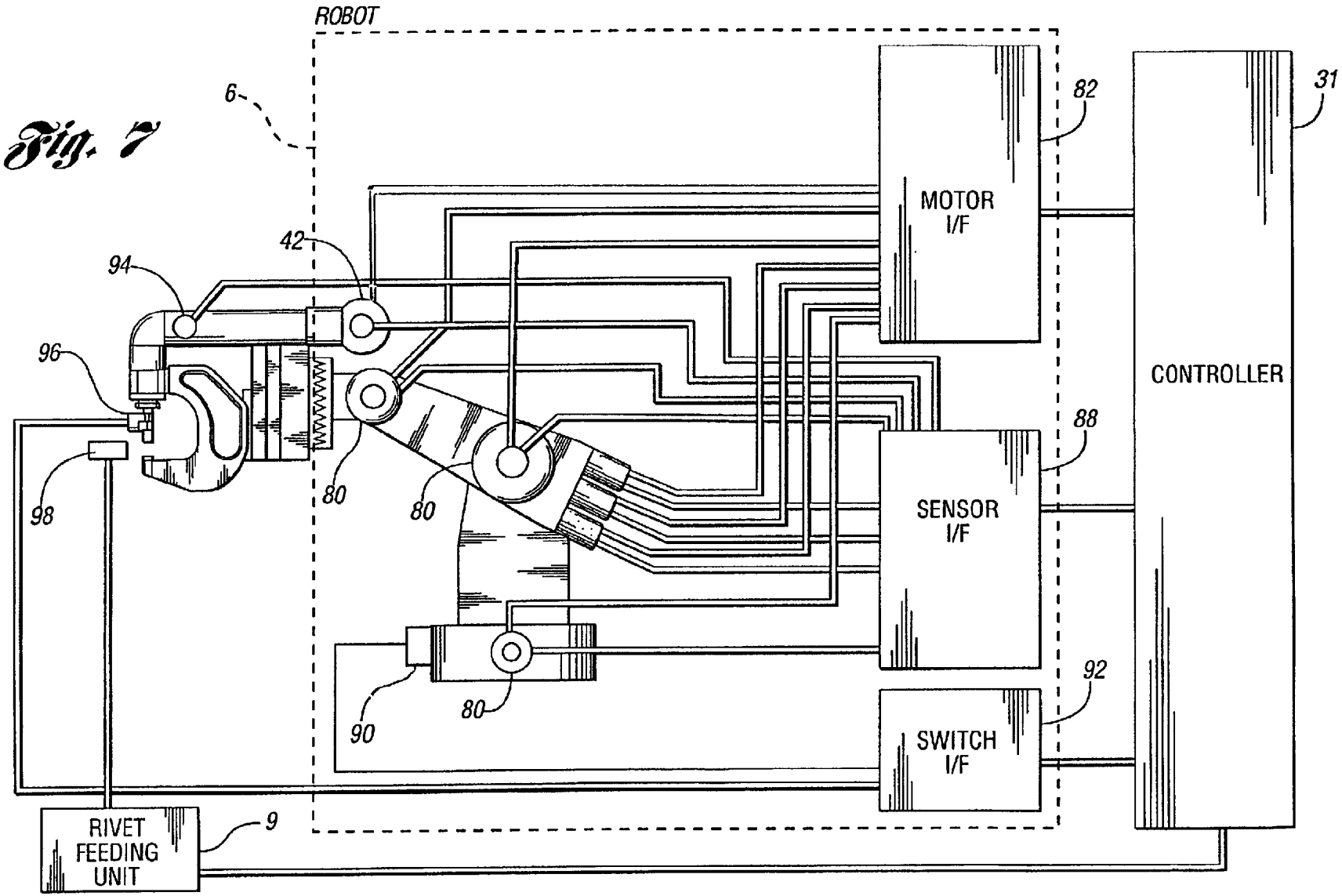
FIG. 7 is a schematic diagram showing the electrical connections for the rivet setting system of the present invention.

A more detailed description of the electrical connections for the rivet setting system 30 is provided in relation to FIG. 7. For illustration purposes, the robot 6 may provide six degrees of motion. Accordingly, the robot 6 is equipped with six electric motors 80, where each electric motor 80 provides robot movement along a different axis. The actuation of each electric motor is controlled via control signals sent by the integrated controller 31 to the robot 6. The control signals are received by a motor interface 82 associated with the robot 6 which in turn transmits control signals to the corresponding electric motor. The integrated controller 31 may also monitor the movement and operation of the robot 6. For instance, each electric motor 80 may be further equipped with encoders (not shown) for reporting position data as is well known in the art. In this case, the robot position data is reported via a sensor interface 88 back to the integrated controller 31. Likewise, limit switches 90 and other safety devices may also be employed to facilitate operation of the robot 6 as is well known in the art. A switch interface 92 is used to communicate such information to the integrated controller 31.

In addition to controlling the movement of the robot 6, the integrated controller 31 also monitors and controls the operation of the rivet swaging assembly 35. The control signals for the electric drive motor 42 are preferably sent via the motor interface 82 associated with the robot 6. In other words, the robot 6 is easily adapted to support the function of controlling the electric drive motor 42 of the rivet swaging assembly 35 as shown in FIG. 7. The operation of the rivet swaging assembly 35 may be monitored, including (but not limited to) measuring the riveting pressure applied to the punch, measuring a displacement of the punch in response to the riveting pressure, as well as measuring, prior to riveting, the length of a self-piercing rivet. A position sensor 94, a limit switch 96 and/or other needed instrumentation may be used to monitor the operation of the rivet swaging assembly 35. Each of the electrical connections between the integrated controller 31 and the robot 6 are implemented via interface cable 33.

Lastly, the integrated controller 31 is electrically connected to the rivet feeder 9. Rivets are feed from the rivet feeder 9 via a feed tube 15 to a receiver mechanism 17 arranged adjacent to the punch 41. Controls signals are sent by the integrated controller 31 via interface cable 34 to the rivet feeder 9. In addition, a feed sensor 98 is positioned adjacent to the receiver mechanism 17. The feed sensor 98 provides feedback to the integrated controller 31 as to when a rivet is present at the head of the punch 41. In this way, the integrated controller 31 also monitors and control the operation of the rivet feeder.

Figure 8:
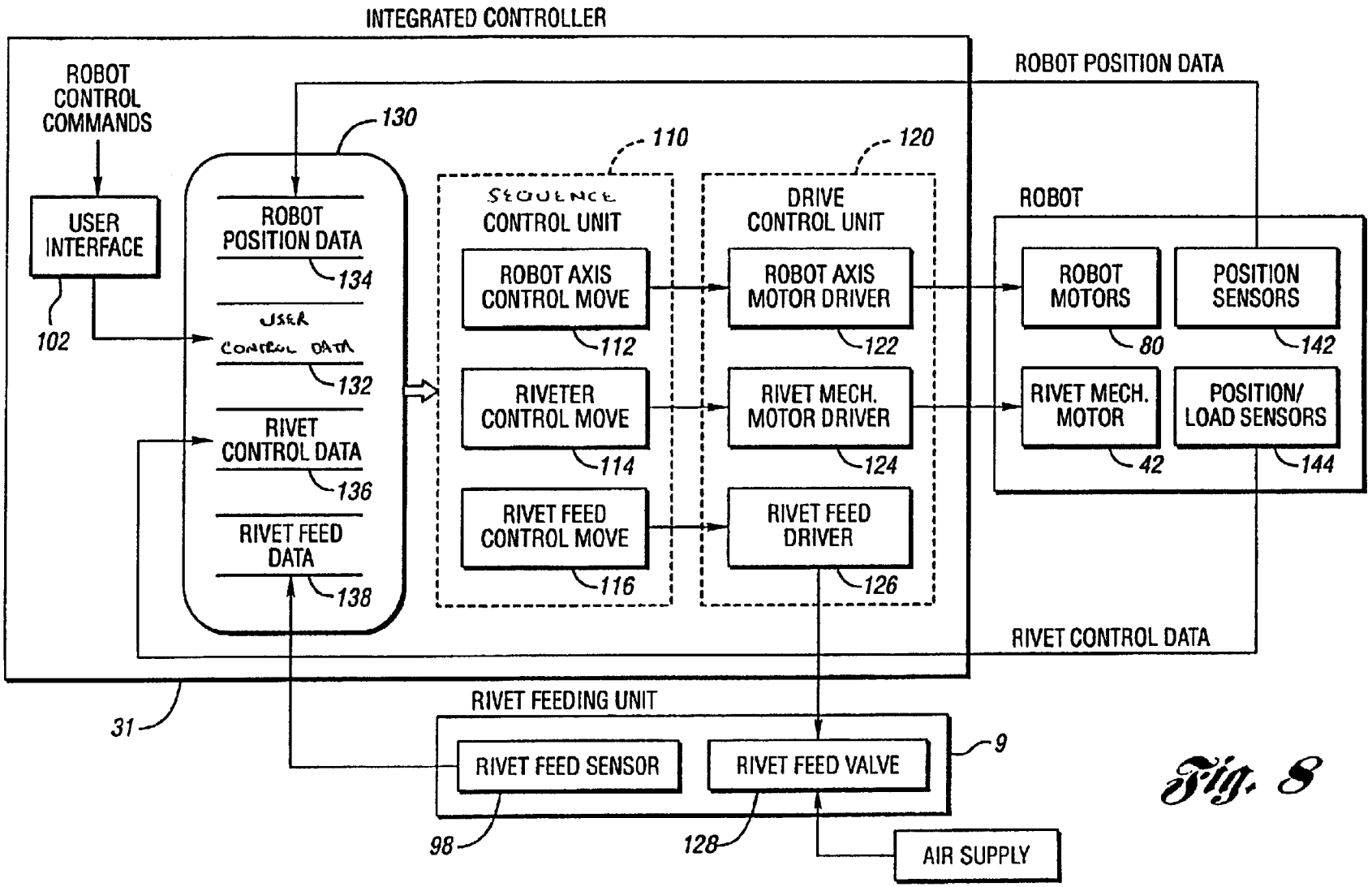
FIG. 8 is functional control block diagram showing the primary control components of the rivet setting system of the present invention.

Referring to FIG. 8, a functional control block diagram is provided for the self-piercing type rivet setting system 30 of the present invention. As noted above, the integrated controller 31 controls the overall operation of the system, including the interaction between the rivet swaging assembly 35, the rivet feeder 9, and the robot 6. To do so, the integrated controller 31 generally includes a user interface 102, a sequence control unit 110 for synchronizing the operation of the controlled devices, and a drive control unit 120 for issuing control signals to each controlled device. As will be more fully explained below, the integrated controller 31 also includes a memory space 130 for storing various control data used to synchronize the operation of the rivet setting system. The integrated controller 31 may be implemented using a microcontroller, a personal computer or other type of computing device which includes a microprocessor and one or more memory storage devices.

The integrated controller 31 provides an user interface 102 as is well known in the art. The user interface 102 facilitates input of various user control commands as well as outputs operational status information. The user interface 102 may include a plurality of user actuated knobs and switches, an alpha-numeric keypad and/or a display device. The user control commands are then stored in a data structure 132 for subsequent processing by the sequence control unit 110.

The sequence control unit 110 is comprised of a robot axes control module 112, a riveting control module 114 and a rivet feed control module 116. These software-implemented modules interact to formulate the control commands for the system. The control commands are in turn sent to the drive control unit 120. The drive control unit 120 is comprised of a robot axes motor driver 122, a rivet mechanism motor driver 124, and a rivet feed driver 126. Each software-implemented driver receives applicable control commands from the sequence control unit 110 and converts the control commands into corresponding control signals. The control signals are in turn sent to the applicable drive motor 80 associated with the robot 6. For instance, to initiate a riveting operation, a control signal is sent to the drive motor 42 of the rivet swaging assembly 35. In the case of the rivet feed driver 126, the control signal is sent to an electro-magnetic valve 128 on the rivet feeder 9.

In order to synchronize the operation of the rivet setting system, various data may be collected and stored by the system. For instance, position sensors or encoders 142 may be used to report position data concerning the spatial location of the robot 9. The robot position data may be communicated to and stored in a data structure 134 residing on the integrated controller 31. One or more sensors 144 may also be used to report control data indicative of the riveting operation carried out by the rivet swaging assembly 35. For example, a load sensor may be used to measure the riveting pressure applied to the punch and/or a position sensor may be used to measure the displacement of the punch. It is envisioned that other sensors, switches, and/or other measurement instrumentation may be used to gather rivet control data. In any event, the rivet control data is communicated to and stored in a data structure 136 residing on the integrated controller 31. Similarly, a rivet feed sensor 98 is used to report rivet feed data to the integrated controller 31. Again, the rivet feed data is stored in a data structure 138 residing on the integrated controller 31. Each of the above-identified data structures reside in a memory space 130 accessible to the sequence control unit 110.

Figure 9:
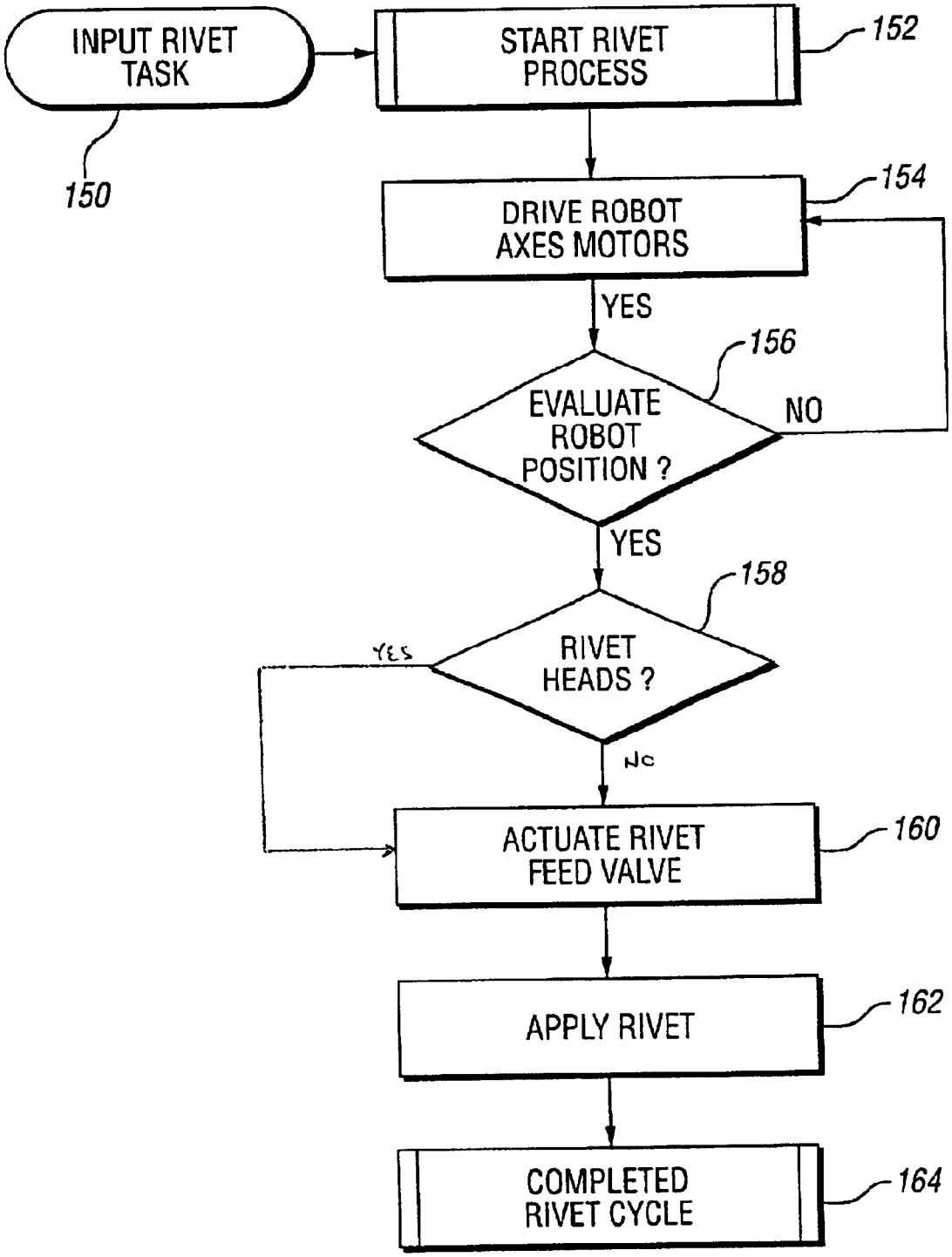
FIG. 9 is an overview control flowchart employed by the computer software embodied in the integrated controller of the present invention.

FIG. 9 illustrates an overview control flowchart employed by the computer software embodied in the integrated controller 31. A rivet task input 150 by the operator via the user interface initiates the rivet process. The rivet task should specify the type of rivet operation, various parameters associated with the rivet operation (e.g., load pressure, release point, etc.), as well as position data for the robot. Initially, robot position data is used to drive the robot axis motors 154 to the desired rivet location. A feedback approach is used to evaluate the robot position in relation to the desire robot position as shown at step 156. If necessary, the robot position may be further compensated to obtain the desired rivet location.

Next, the integrated controller 31 verifies that a rivet is resent 158 in the rivet swaging assembly 35. If not, the electromagnetic valve associated with the rivet feeder is actuated at step 160, thereby feeding a rivet to the rivet swaging assembly 35. Lastly, the rivet is driven by the punch 41 and die 39 into a workpiece as step 162. This completes the rivet cycle. It is to be understood that only the primary steps of the methodology are discussed above, but that other software-implemented instructions are needed to control and manage the operation of the rivet setting system. Moreover, the above methodology illustrates how the integrated controller 31 of the present invention synchronizes the operation of the rivet setting systems.

As described above, since in the present invention, a rivet swaging assembly 35, a controller for the rivet feeder 9 and a controller for the robot 6 are all combined into a single integrated controller 31, neither the housing for the first controller required in the conventional apparatus nor the interface cable connecting both controllers is necessary. Since, in addition to the integration of both controllers into a single controller, the rivet swaging assembly 35 is incorporated into a moving means such as the robot 6, the interface cable extending from the controller for the rivet swaging assembly to the rivet swaging assembly is no more necessary, though required in the conventional apparatus. Accordingly, the rivet swaging assembly can be placed in position desirably relative to the predetermined site to be riveted on a workpiece without interfering with complexity of the geometry of a car body or the like. Further, the present invention allows to reduce a size of a controller as a whole, a cost thereof, a size of a self-piercing type rivet setting system, and a number of cables as well.

It should be noted that since the controller for the robot has a function of controlling the electric motor as well as the robot, a function of controlling the electric drive motor of the rivet swaging assembly would be easily added thereto so that the function of the controller for the rivet swaging assembly could be simply obtained from the controller for the robot. Further, a function of controlling the articulated robot along one of the axes thereof may be available for controlling the drive motor of the rivet swaging assembly. Still further, in the disclosed embodiment, the rivet swaging assembly for the self-piercing type rivet is mounted on a front end shaft of the arm 37 of the robot 37. In this case, a heavy and large electric drive motor may be mounted directly to the robot axis to reduce in size the front end portion of the robot. Alternatively, a drive motor for one of the axes of the articulated robot may be available to be used for the electric drive motor of the rivet swaging assembly, so that the coupling device 45 for coupling the integrated controller 31 with the rivet swaging assembly 35 would be unnecessary and thus, an apparatus could be reduced in size and weight, and the movement of the rivet swaging assembly would be made easier, and the interference with the workpiece to be riveted would be reduced as well.

In general, the above-identified embodiments are not to be construed as limiting the breadth of the present invention. It is understood that other modifications or other alternative constructions will be apparent which are within the scope of the invention as defined in the appended claims.

What is claimed is:

1. A riveting system comprising:

(a) an articulated robot including at least one robot sensor operable to report position data indicative of the position of at least a portion of the robot;

(b) a riveting mechanism including:

(i) an electric motor;

(ii) a transmission operably driven by the electric motor;

(iii) a rivet advancing punch operably moved by the transmission, a self-piercing rivet substantially prevented from contacting the die when joining workplaces, and the transmission including a lead screw and operably transmitting rotary motion of the motor to linear motion for punch; and (iv) a substantially C-shaped frame at least a portion of which is located adjacent the punch;

(c) at least one rivet sensor operably sending a signal in response to a riveting characteristic; and (d) a single, integrated controller electrical connected to the robot and the electric motor of the riveting mechanism, the single controller operably controlling movement of the robot and operation of the riveting mechanism, the controller operably receiving the robot position data and synchronizing the operation of the riveting mechanism with the movement of the robot and the controller operably determining if a value sensed by the rivet sensor is within a predetermined range.

2. The system of claim 1 wherein the riveting characteristic is riveting force applied by the punch.

3. The system of claim 1 wherein the riveting characteristic is rivet length.

4. The system of claim 1 wherein the riveting characteristic is workpiece thickness.

5. The system of claim 1 further comprising a rivet feeder electrically connected to and controlled by the single controller.

6. The system of claim 1 wherein the self-piercing rivet is substantially prevented from completely piecing through all workpieces being joined.

7. The system of claim 1 wherein at least a portion of the transmission is located above a horizontal plane extending through the center of an articulation joint of the robot positioned closest to the riveting mechanism, when an elongated centerline of the punch is vertical.

8. The system of claim 1 wherein the electric motor is offset from an elongated centerline of the punch.

9. A riveting apparatus comprising:

(a) a robot including at least one robot sensor operable to report robot position data indicative of the position of at least a portion of the robot;

(b) a riveting machine having an electric motor actuator, drive mechanism, punch, C-frame and die, energization of the actuator operably causing the drive mechanism to advance the punch toward the die, the drive mechanism further comprises a lead screw and the drive mechanism operably transmitting rotary motion of the actuator to linear motion for the punch, the riveting machine being coupled to the robot;

(c) an integrated controller connected the robot and the actuator of the riveting machine; and (d) a self-piercing rivet being substantially prevented from contacting the die when joining workpieces;

(e) the controller operably causing the robot to move the riveting machine and operably causing the punch to drive the self-piercing rivet relative to the die, (f) the controller operably receiving the robot position data and synchronizing the operation of the riveting machine with the movement of the robot; and (g) the controller operably determining if a sensed value related to riveting characteristic is within a predetermined range.

10. The apparatus of claim 9 wherein the riveting characteristic is rivet length.

11. The apparatus of claim 9 wherein the riveting characteristic is workpiece thickness.

12. The apparatus of claim 9 wherein a rotational axis of the electric motor is offset from an elongated axis of the punch.

13. The apparatus of claim 9 wherein the robot is electrically articulated.

14. The apparatus of claim 9 further comprising a rivet feeder electrically connected to and controlled by the single controller.

15. A riveting system, comprising:

an electrically actuated robot having at least one member movable in a predefined workspace, the robot being adapted to receive robot control commands and being operable to move the member in accordance with the robot control commands;

at least one robot sensor operable to report robot position data;

a riveting mechanism coupled to the member, wherein the riveting mechanism further comprises an electric motor, a transmission operably driven by the electric motor, a rivet advancing punch operably moved by the transmission, and a die spatially aligned with the punch, the rivet mechanism being operable to drive the punch relative to the die such that a self-piercing rivet is substantially prevented from contacting the die when joining workpieces;

at least one riveting sensor associated with the riveting mechanism and being operable to report rivet control data indicative of the operation of the riveting mechanism;

a single, integrated controller electrically connected to the riveting mechanism and the robot, the controller being adapted to receive robot control commands and rivet control data and being operable to synchronize the operation of the riveting mechanism with the movement of the robot;

a data structure accessible to the integrated controller for storing the robot control commands and the rivet control data; and at least one robot sensor associated with robot being operable to report robot position data indicative of the position of the robot member;

the controller being adapted to receive the robot position data and synchronize the operation of the riveting mechanism with the movement of the robot.

16. The riveting system of claim 15 wherein the riveting sensor is further defined as a load sensor operable to report riveting force applied to the punch.

17. The riveting system of claim 15 wherein the riveting sensor is further defined as a position sensor operable to report displacement of the punch.

18. The riveting system of claim 15 wherein the sensor associated with the riveting mechanism is further defined as a feed sensor operable to report rivet feed data indicative of the placement of the rivet adjacent the punch.

19. A fastening apparatus comprising:

(a) a robot including at least one robot sensor operable to report robot position data indicative of the position of at least a portion of the robot;

(b) a machine having an electric motor actuator, drive mechanism, punch, C-frame and die, energization of the actuator operably causing the drive mechanism to advance the punch toward the die, the drive mechanism further comprises a lead screw and the drive mechanism operably transmitting rotary motion of the actuator to linear motion for the punch, the machine being coupled to the robot;

(c) an integrated controller connected to the robot and the actuator of the machine; and (d) a self-piercing fastener being substantially prevented from contacting the die when joining workpieces;

(e) the controller operably causing the robot to move the machine and operably causing the punch to drive the self-piercing fastener relative to the die;

(f) the controller operably receiving the robot position data and synchronizing the operation of the machine with the movement of the robot; and (g) the controller operably determining if a sensed value related to fastening is within a predetermined range.

* * * * *

UNITED STATES PATENT AND TRADEMARK OFFICE

CERTIFICATE OF CORRECTION

PATENT NO. : 6,789,309 B2
DATED : September 14, 2004
INVENTOR(S) : Yoshiteru Kondo It is certified that error appears in the above-identified patent and that said Letters Patent is hereby corrected as shown below:

Column 8,
Line 61, "workplaces" should be -- workpieces --.
Line 63, after "for" insert -- the --.

Column 9,
Line 1, "electrical" should be -- electrically --.
Line 45, after "connected" insert -- to --.
Line 57, after "to" insert -- a --.

Column 10,
Line 19, "rivet" should be -- riveting --.
Line 30, after "commands" insert -- , robot position data, --.
Line 34, after "robot" insert -- and --.
Line 37, delete "and".
Lines 38-43, delete the following paragraphs:

"at least one robot sensor associated with robot being operable to report robot postion data indicative of the position of the robot member;

the controller being adapted to receive the robot position data and synchronize the operation of the riveting mechanism with the movement of the robot".

Signed and Sealed this

Twenty-first Day of December, 2004

JON W. DUDAS
*Director of the United States Patent and Trademark Office*